US006308769B1

(12) United States Patent
Pleschiutschnigg et al.

(10) Patent No.: US 6,308,769 B1
(45) **Date of Patent: *Oct. 30, 2001**

(54) CONTINUOUS CASTING PLANT FOR CASTING SLABS WITH A CONTINUOUS CASTING MOLD AND A STRAND GUIDING UNIT COMPOSED OF ROLLERS

(75) Inventors: Fritz-Peter Pleschiutschnigg, Duisburg; Joachim Schwellenbach, Düsseldorf, both of (DE)

(73) Assignee: SMS Schloemann-Siemag Aktiengesellschaft, Düsseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,705

(22) Filed: Nov. 12, 1998

(30) Foreign Application Priority Data

| | | |
|---|---|---|
| Nov. 21, 1997 | (DE) | 197 51 709 |
| Jul. 22, 1998 | (DE) | 198 32 923 |
| Oct. 28, 1998 | (DE) | 198 49 603 |

(51) Int. Cl.[7] ..... B22D 11/12
(52) U.S. Cl. ..... 164/442; 164/448; 164/417
(58) Field of Search ..... 164/484, 442, 164/448, 476, 417

(56) References Cited

U.S. PATENT DOCUMENTS

| | | | | |
|---|---|---|---|---|
| 4,022,369 | * | 5/1977 | Wunnenberg | 164/448 |

FOREIGN PATENT DOCUMENTS

| | | | | |
|---|---|---|---|---|
| 2504558 | | 8/1976 | (DE) . | |
| 0041498 | | 12/1981 | (EP) . | |
| 0350431 | | 1/1990 | (EP) . | |
| 0535368 | | 4/1993 | (EP) . | |
| 57-209759 | * | 12/1982 | (JP) | 164/442 |
| WO95/20445 | | 8/1995 | (WO) . | |
| WO98/20998 | | 5/1998 | (WO) . | |

* cited by examiner

*Primary Examiner*—Nam Nguyen
*Assistant Examiner*—I.-H. Lin
(74) *Attorney, Agent, or Firm*—Friedrich Kueffner

(57) ABSTRACT

A continuous casting plant suitable for casting steel slabs, wherein the partially solidified strand composed of a strand shell and a partially liquid core is guided after emerging from the mold during the further solidification between the rollers of a strand guiding unit which has a loose or movable side and a fixed side, and wherein the strand shell forms in the areas between always two rollers spaced apart from each other in the casting direction a deformation in the form of a bulge with an increase of the cross-section. For compensating for an increase of the cross-section of a respective strand portion, a counter-pressure is applied from the outside against the strand area located opposite the strand portion with the increased cross-section in order to reduce the cross-section.

8 Claims, 5 Drawing Sheets

CONTINUOUS CASTING PLANT FOR CASTING SLABS WITH A CONTINUOUS CASTING MOLD AND A STRAND GUIDING UNIT COMPOSED OF ROLLERS

BACKGROUND OF THE INVENTION

1. Field of the Invention

The present invention relates to a method of continuously casting steel slabs with a continuous casting mold, wherein the partially solidified strand composed of a strand shell and a partially liquid core is guided after emerging from the mold during the further solidification between the rollers of a strand guiding unit which has a loose or movable side and a fixed side, and wherein the strand shell forms in the areas between always two rollers spaced apart from each other in the casting direction a deformation in the form of a bulge with an increase of the cross-section.

The present invention also relates to a continuous casting plant suitable for carrying out the method.

2. Description of the Related Art

As a rule, a strand guiding unit suitable for a secure guidance of the cast strand includes a large number of individual strand guiding segments which closely interact in order to guide the strand, wherein the strand guiding segments are provided with guide rollers and/or drive rollers arranged in a loose or movable frame and in a fixed frame, wherein the rollers together form a so-called roller carpet. The rollers may be supported continuously, or intermediate supports may be provided for the rollers in the case of comparatively large strand widths.

Groups of the rollers on the fixed side and the loose side arranged at a distance from the meniscus in the mold have different diameters, while rollers arranged opposite each other to form a pair have the same diameters.

When the strand is guided along a curve between vertical and horizontal sections, the segments are located in the radius ray, starting from the vertical direction underneath the mold up to the horizontal direction.

EP 0 350 431 A2 discloses a continuous casting method for slabs with a continuous casting mold. The strand which is partially solidified over the cross-section thereof is guided between pairs of rollers and is pulled off by means of driven rollers. The individual rollers of pairs of rollers can be adjusted hydraulically relative to the strand so as to deform the strand.

EP 0 535 368 A1 discloses a method and a plant for manufacturing steel strip. In this method, a continuously cast steel strip, which is composed of a solidified strand shell and a liquid core, is reduced in its thickness by deformation by means of rollers and is subsequently rolled.

For preventing undesired thickness deviations and for improving the structure as well as for simplifying the rolling deformation unit, a steel strip strand of 40–80 mm thickness is cast, is deformed by rolling to a thickness of 15–40 mm and 2–15 mm residual liquid in at most three stages and is guided until it is fully solidified.

When carrying out deformation by rolling of a partially solidified steel strand, it has been found that this deformation may lead to strand deformations in the form of bulges of the strand shell between always two adjacent roller contact lines with the strand shell. This produces alternating zones of increased cross-sections and zones of smaller cross-sections, so that the residual melt in the interior of the strand pulsates.

These bulges may lead to critical shell deformations, particularly at the phase border between liquid and solid and, thus, to the formation of internal cracks as a result of the pulsating residual melt movement as a consequence of the periodic bulging of the strand shell and under the influence of the ferrostatic pressure of the liquid steel column which extends up to the meniscus in the mold.

The maximum bulging $W_{max}$ of the strand shell with liquid core between two adjacent rollers in the casting direction is essentially determined by the following factors:

temperature, T [K]

metallurgical height, h [m]

distance between rollers, L [m]

casting speed, V [m/min]

strand shell, S [mm], wherein the maximum bulging $W_{max}$ is determined in the first approximation in accordance with the equation $$W_{max}=7{,}86*10^{-12}\ \exp.(0{,}0046*T)\ h^{2.25}*L^{6.1}*V^{-0{,}57}*S^{-5{,}26}.$$

When observing the liquid to be displaced (predominantly a two-phase mixture of crystals and molten steel) during the bulging of the strand shell from roller pair to roller pair, it can be seen that the volume to be displaced builds up a pressure tensor which depends on the ferrostatic pressure, the casting speed, the volume and the travel distance.

In a continuous casting plant, the volume between two pairs of rollers of the roller guiding unit consists of two half volumes which are to be assigned to the fixed side and the loose side of each segment. When this volume of the molten steel is displaced, it exerts a high pressure against the strand shell as it becomes narrower and causes the generation of bulges, while the system strand/strand bulging is superimposed negatively multiplied and leads to uncontrolled movements of the molten steel in the meniscus.

SUMMARY OF THE INVENTION

Therefore, starting from the prior art discussed above, it is the primary object of the present invention to provide a method of continuously casting steel slabs and a continuous casting plant for carrying out the method in which it is possible to eliminate the disadvantages and difficulties described above and particularly to suppress or compensate for the generation of harmful periodic bulging of the strand shell as it is being deformed by the rollers.

In accordance with the present invention, for compensating for an increase of the cross-section of a respective strand portion, a counter-pressure is applied from the outside against the strand area located opposite the strand portion with the increased cross-section in order to reduce the cross-section.

The continuous casting plant according to the present invention includes a strand guiding unit with rollers which, for compensating the deformations of the strand, are arranged offset relative to each other by at least a portion of the distance between the rollers.

Accordingly, in accordance with the present invention, the method for compensating the increased cross-section of a strand portion subjected to bulging provides for the application of a sufficient counter-pressure for reducing the cross-section at the bulge from the outside; this comparatively and surprisingly uncomplicated measure makes it possible to compensate the effect of a bulge at least for the most part and, thus, to significantly suppress the harmful pulsating of the residual molten steel in the cast strand.

The continuous casting plant according to the present invention meets the above described object in a surprisingly uncomplicated manner and practically without increased costs by a configuration in which the rollers of each strand guiding segment are at least partially offset relative to each other by a portion of the distance between the rollers. Specifically, the rollers on one side of the strand are arranged offset relative to the rollers on the other side of the strand.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1A:
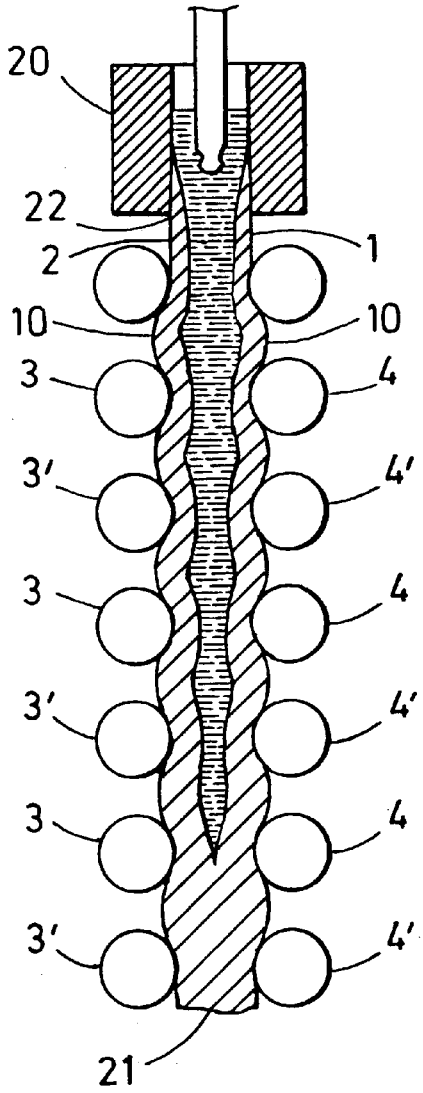
FIG.1A PRIOR ART
FIG. 1*a* is a cross-sectional view of a strand guiding unit according to the prior art.

The strand guiding units illustrated in FIG. 1*a* according to the prior art has a mold 20 with mold outlet 22. Illustrated underneath the mold 20 is a cast strand 21 which is in the process of solidifying, wherein the strand shell 1 increases in thickness with increasing solidification, while the relative volume of the residual molten steel 2 enclosed by the strand shell 1 decreases until it is finally completely solidified. In the region where the strand 21 solidifies, the strand 21 is guided between the rollers 4, 4' on the fixed side and rollers 3, 3' on the loose side of strand guiding segments.

The mold 20 and the strand guiding unit are part of a continuous casting plant which is not illustrated in detail and is intended preferably for casting slabs of steel having a continuous casting mold with sizes of between 40–250 mm thickness, widths of 500–3,500 mm and casting speeds of between 1 and 10 m/min.

Between always two rollers 3, 3' in the casting direction can be seen the above-described harmful bulges 10 in which increases of the volume of the residual molten steel content take place, wherein these volume increases periodically alternate during the transport of the strand 21 with volume restrictions between each pair of roller and lead to extremely disadvantageous "pumping" movements of the molten steel.

Figure 1B:
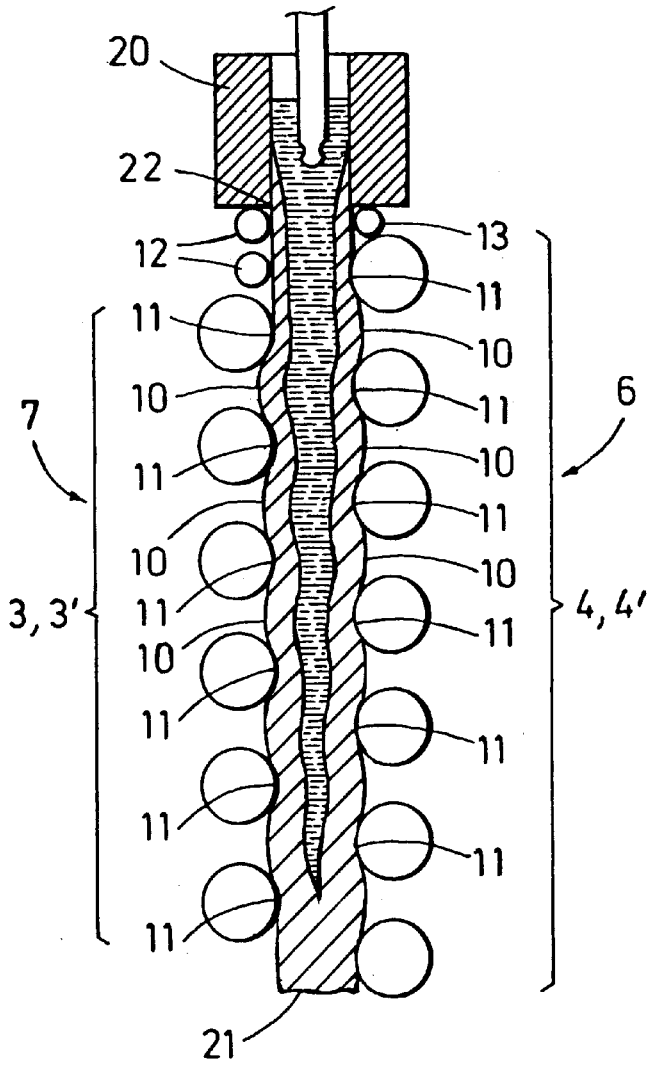
FIG. 1*b* is a cross-sectional view of a strand guiding unit according to the present invention.

FIG. 1*b* of the drawing shows the configuration of a strand guiding unit according to the present invention. In this case, for compensating the increases of the cross-section in the areas between rollers, a counter-pressure is applied from the outside for producing an indentation 11 which decreases the cross-section. For this purpose, the rollers are offset relative to each other in the casting direction at least by a portion of the distance between the rollers, preferably by half the distance between the rollers.

FIG. 1*b* clearly shows the advantageous compensating effect which can be achieved according to the present invention by reducing the harmful volume increases between always two adjacent guide rollers 3, 3' and 4, 4'. As a result of the invention, the bulge 10 and, thus, the volume increase of the liquid content, is at most half that of the arrangement of FIG. 1*a*.

Figure 2B:
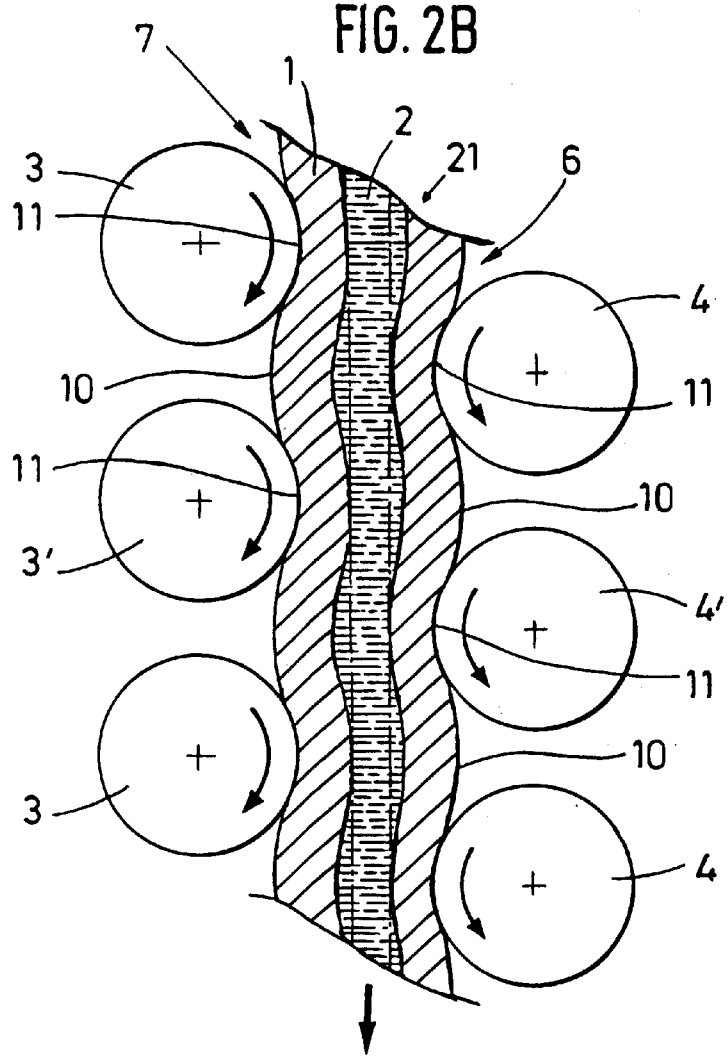
FIG. 2*b* is a cross-sectional view, on a larger scale, of a strand guiding unit according to FIG. 1*b;*
Figure 2A:
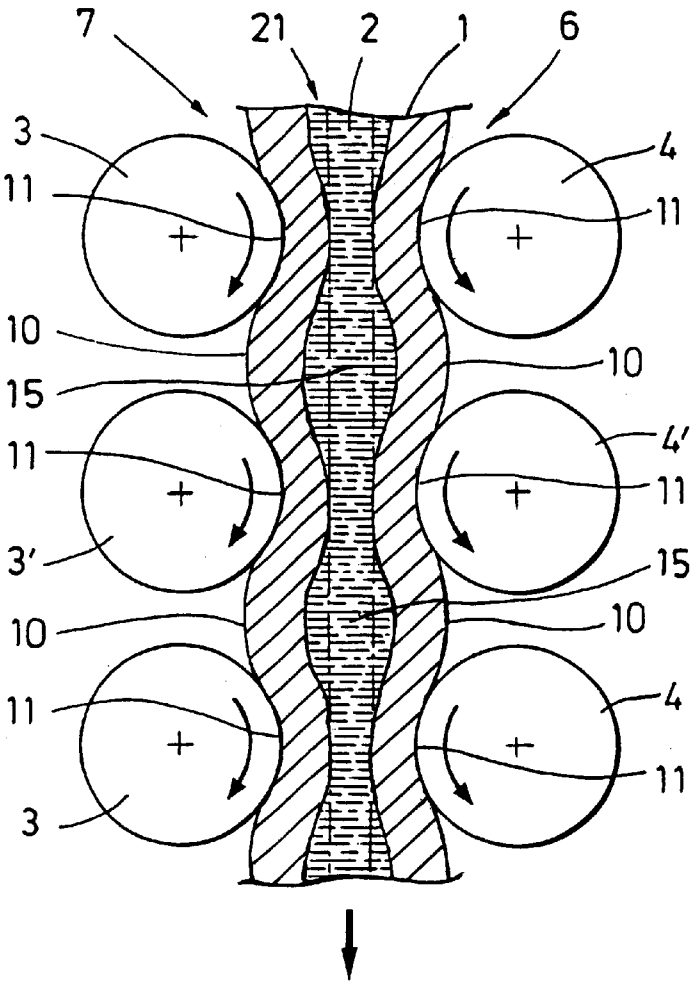
FIG. 2A PRIOR ART
FIG. 2*a* is a cross-sectional view, on a larger scale, of a strand guiding unit according to FIG. 1*a;*

FIGS. 2*a* and 2*b* show on a larger scale that the appropriate arrangement of the cast strand 21 and the rollers 3, 3' and 4, 4' with an unchanged shell 1 produce in the case of the strand guiding unit according to the prior art shown in FIG. 2*a* as compared to the configuration according to the present invention shown in FIG. 2*b* bulges 10 which because of the oppositely directed indentations 11 are at most half the corresponding values in accordance with FIG. 2*a*. In FIG. 2*a*, for a better illustration, the areas with increased volume are denoted with 15, while the constrictions or indentations are denoted by 11.

Figure 3:
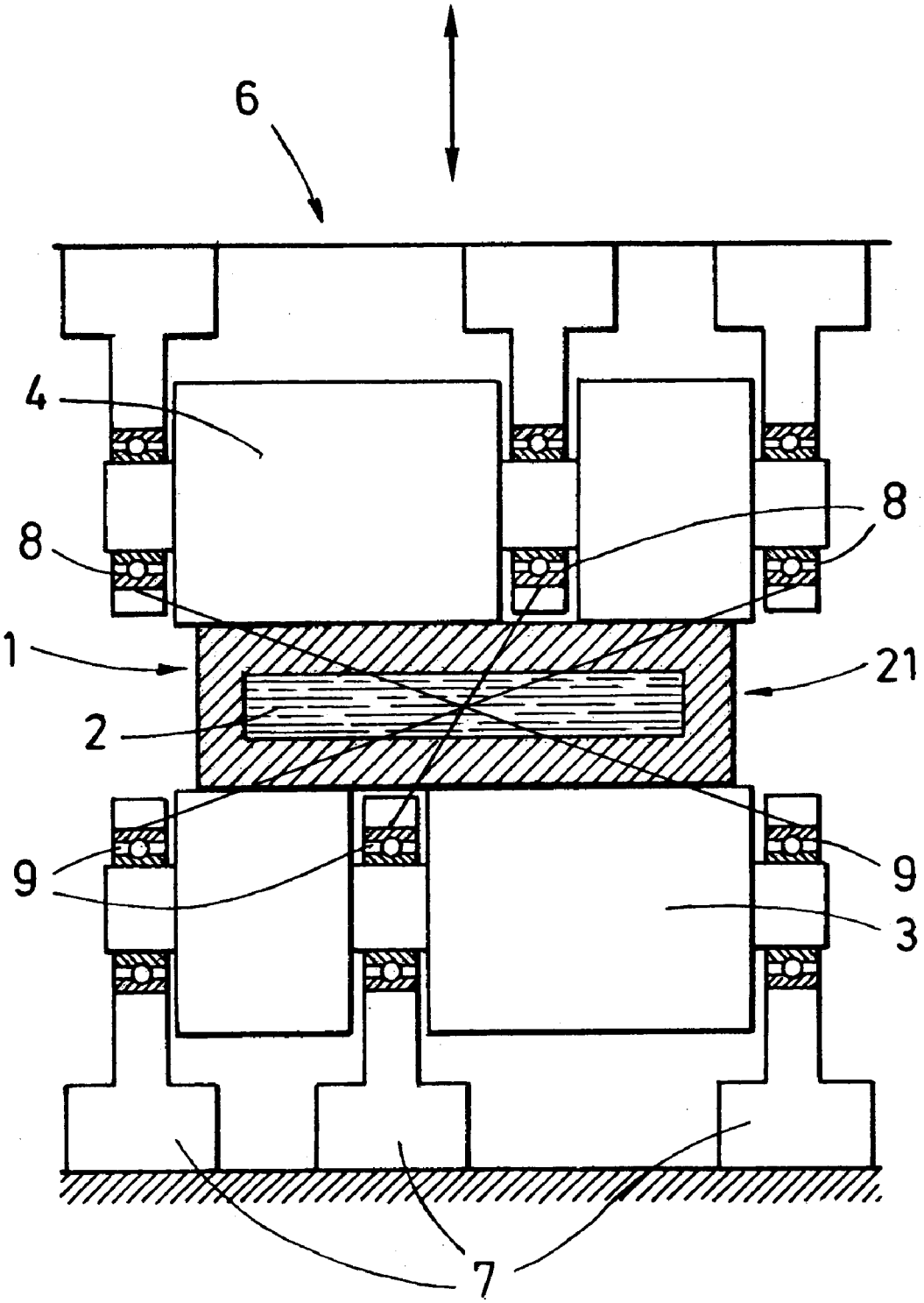
FIG. 3 is a top view of rollers with intermediate support relative to the position of a cross-sectional illustration of a cast strand guided by the rollers.

FIG. 3 shows the arrangement of rollers 3, 4 with intermediate support, wherein the bearings 8, 9 of the loose side and the fixed side 6, 7 are preferably arranged so as to be symmetrical with respect to a center point. Even in the case of oppositely located rollers 3, 4 which are offset relative to each other, for example, by 50% of the distance between the rollers, these rollers are not arranged symmetrical with respect to an area, but symmetrical with respect to a point, wherein this arrangement results in bulging and volume movement of the molten steel which is minimized with respect to time and location.

Figure 4:
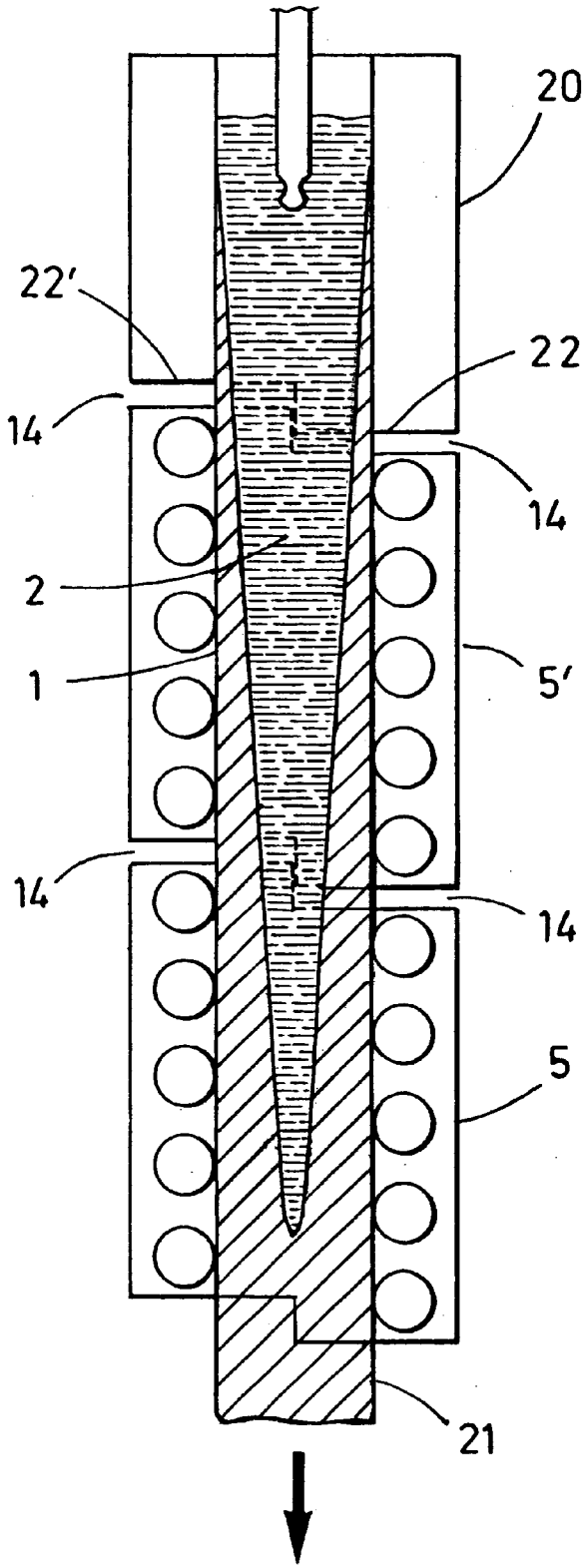
FIG. 4 is a cross-sectional view of a vertical roller guiding unit, wherein the rollers are arranged in segments with tooth-like engagement between the segments.

FIG. 4 shows an arrangement of roller segments 5, 5' of a vertical guiding unit for a cast strand 21 underneath a mold 20. Since the rollers on opposite sides are offset relative to each other, the segments 5, 5' are joined together with toothed or stepped surfaces 14. In that case, one half 22 or 22' of the mold outlet of the mold 20 is shortened or extended relative to the other half in order to form a toothed or stepped surface 14, 14' for engagement with the adjacent strand guiding segment 5', wherein the shortening or elongation of one half of the mold outlet is by half a distance between the rollers. In the same manner, the loose side 6 of each strand guiding segment 5 or 5' provided with rollers is offset by at least a portion of the distance between the rollers so as to form the toothing or step 14 or 14'. The toothing engagement with the first roller segment can also be ensured by a grid plate which is normally connected to the outlet of the mold.

FIG. 4 clearly shows the increase in thickness of the strand shell 1 in vertical direction and the decreasing content of molten steel 2.

It should be added in connection with FIG. 1*b* that when the mold 20 has a planar configuration of the outlet 22, the mold 20 is provided on one side thereof, for example, opposite the fixed side 7, with n+1 base rollers 12 and with base rollers 13 on the opposite loose side 6 in order to produce a toothed engagement 14 with the first strand guiding segment 5'.

Figure 5:
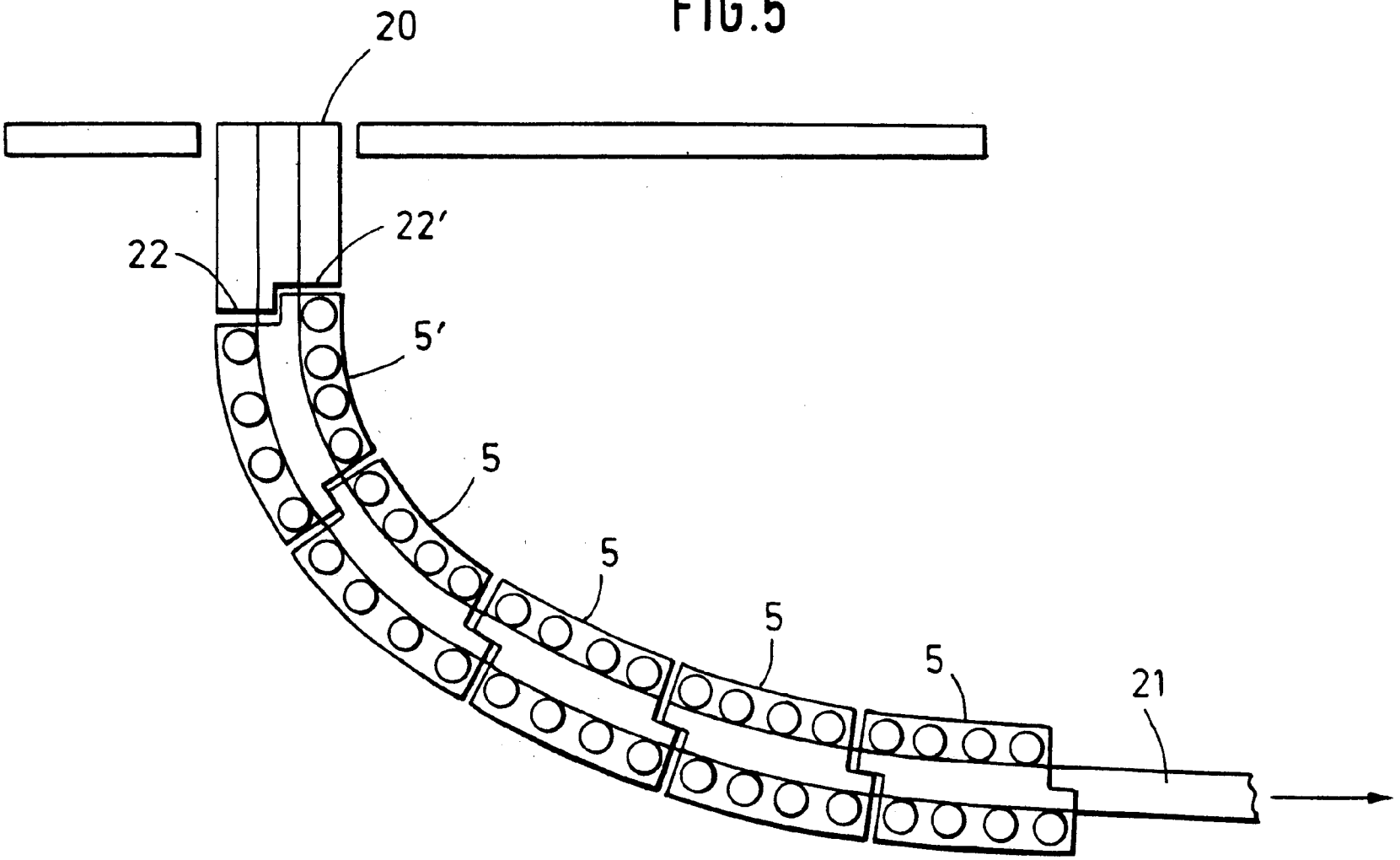
FIG. 5 is a cross-sectional view of a continuous casting plant with a curved roller guiding unit with toothed segments.

FIG. 5 of the drawing shows a curved strand guiding unit for guiding the strand from the vertical into the horizontal directions, wherein the strand guiding unit is also provided with segments 5, 5'. These segments are arranged one behind the other in the area of the curved portion in accordance with the shown radius rays. The first segment 5' following the mold 20 is arranged such that the fixed side is connected to the extended outlet part 22 of the mold 20 and the loose side is connected to the shortened outlet part 22' of the mold 20, so that a toothed engagement is obtained. In the curved portion, single-roller clusters are arranged at the fixed side always at the exit of the segment, so that a rapid exchange of the roller segments is possible.

While specific embodiments of the invention have been shown and described in detail to illustrate the inventive principles, it will be understood that the invention may be embodied otherwise without departing from such principles.

We claim:

1. A continuous casting plant for manufacturing steel slabs, comprising a continuous casting mold and a vertically extending strand guiding unit with guiding segments each having a loose side and a fixed side with rollers for guiding a strand composed of a strand shell and a liquid core after emerging from the mold and during a further solidification, wherein the rollers on the loose side and on the fixed side of each segment are offset relative to each other by at least a portion of a distance between the roller, wherein the rollers are offset relative to each other at most half the distance between the rollers.

2. The continuous casting plant according to claim 1, wherein each segment has toothed end faces for engagement with adjacent segments.

3. The continuous casting plant according to claim 2, wherein the mold has a mold outlet with an extended half and a shortened half forming a toothed end face for engagement with an end face of an adjacent segment.

4. The continuous casting plant according to claim 2, wherein the strand guiding segments form a curved strand guiding unit, and wherein each segment is provided with a single-roller cluster.

5. The continuous casting mold according to claim 1, wherein the rollers have intermediate bearings, and wherein the bearings on the loose side and on the fixed side are arranged symmetrically with respect to a center point.

6. The continuous casting plant according to claim 1, wherein the rollers have a diameter which increases from a first roller immediately underneath the mold to rollers at an end of the strand guiding unit.

7. The continuous casting plant according to claim 6, wherein the diameter of the rollers increases from 100 mm to at most 300 mm.

8. The continuous casting plant according to claim 1, wherein the mold has a planar mold outlet, further comprising n base rollers on the fixed side of the strand guiding unit, and a toothed engagement of the base rollers with an adjacent end face of an adjacent strand guiding segment.

* * * * *